US007001231B1

(12) United States Patent
Halley et al.

(10) Patent No.: US 7,001,231 B1
(45) Date of Patent: Feb. 21, 2006

(54) DUAL WATER INJECTOR FOR PRIMARY AND IDLE RELIEF EXHAUST PASSAGES

(75) Inventors: Stuart M. Halley, Brownsville, WI (US); David J. Belter, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/962,628

(22) Filed: Oct. 11, 2004

(51) Int. Cl.
*B63H 21/38* (2006.01)

(52) U.S. Cl. ..... 440/88 G; 440/89 B

(58) Field of Classification Search ..... 440/89 R, 440/89 B, 88 G, 88 J, 88 K, 89 C, 89 D; 60/320, 321
See application file for complete search history.

(56) References Cited

U.S. PATENT DOCUMENTS

| | | | | |
|---|---|---|---|---|
| 3,198,162 | A * | 8/1965 | Larsen | 440/89 R |
| 3,310,022 | A * | 3/1967 | Kollman | 440/75 |
| 3,911,852 | A * | 10/1975 | Miller et al. | 440/89 R |
| 4,507,092 | A * | 3/1985 | Hall et al. | 440/89 R |
| 5,149,284 | A | 9/1992 | Kawai | 440/52 |
| 5,740,670 | A | 4/1998 | Woods | 60/310 |
| 6,035,633 | A | 3/2000 | Woods | 60/310 |
| 6,151,892 | A | 11/2000 | Brewer et al. | 60/313 |
| 6,406,344 | B1 | 6/2002 | Bland et al. | 440/88 |
| 6,537,116 | B1 | 3/2003 | Nakata et al. | 440/88 |
| 6,644,024 | B1 | 11/2003 | Powers et al. | 60/320 |
| 2003/0121253 | A1 | 7/2003 | Ford et al. | 60/310 |

* cited by examiner

*Primary Examiner*—Sherman Basinger
(74) *Attorney, Agent, or Firm*—William D. Lanyi

(57) ABSTRACT

A water cooling system for an outboard motor provides a water conduit that extends through both an idle exhaust relief passage and a primary exhaust passage. Water within the water conduit flows through first and second openings to distribute sprays or streams of water into first and second exhaust conduits which can be the primary and idle exhaust relief passages of an outboard motor.

10 Claims, 4 Drawing Sheets

DUAL WATER INJECTOR FOR PRIMARY AND IDLE RELIEF EXHAUST PASSAGES

BACKGROUND OF THE INVENTION

1. Field of the Invention

The present invention is generally related to a water injector for use in conjunction with exhaust passages and, more particularly, to a system by which water is injected from a common conduit into both the primary and idle relief exhaust passages of an outboard motor.

2. Description of the Prior Art

Those skilled in the art of marine propulsion systems and, more particularly, outboard motors, are familiar with various ways of cooling the exhaust gases emitted by an internal combustion engine of a marine propulsion system. One known method of reducing the temperature of exhaust gas, as it flows from an internal combustion engine to an exhaust pipe and is emitted from the marine propulsion system, is to spray water directly into the exhaust gas stream. Other methods include the provision of water jackets and other water reservoir cavities to absorb heat from structures through which the exhaust gases pass.

U.S. Pat. No. 5,149,284, which issued to Kawai on Sep. 22, 1992, describes an exhaust system for an outboard motor. The invention is adapted to be embodied in an outboard motor that is comprised of a power head having an internal combustion engine surrounded by a protective cowling. The engine includes an exhaust port in communication with an exhaust pipe for discharging exhaust gases from the engine. A steering shaft is affixed to the driveshaft housing by upper and lower connections which include elastic bushings. An upper reservoir receives cooling water from the engine to cool structures adjacent the exhaust pipe and specifically the elastic bushings. The reservoir is dammed up on the forward side by the bushing and receives cooling from the cooling water.

U.S. Pat. No. 5,740,670, which issued to Woods on Apr. 21, 1998, describes a water jacketed exhaust pipe for marine exhaust systems. A water jacketed exhaust pipe comprises an inner liner, an outer shell, and a spray ring. The inner liner includes an internally tapered section which clips the turbulence that occurs along the inner walls of the liner. As a result, fluid expelled from the spray ring will not migrate into the inner liner where it can cause severe corrosion.

U.S. Pat. No. 6,035,633, which issued to Woods on Mar. 14, 2000, describes a water jacketed exhaust pipe for marine exhaust systems. This patent is closely related to U.S. Pat. No. 5,740,670 and addresses similar functions.

U.S. Pat. No. 6,151,892, which issued to Brewer et al. on Nov. 28, 2000, discloses an internal combustion engine with programmed water injection into its exhaust system. An exhaust system for an internal combustion engine used in a marine propulsion system is provided with a water injection system by which water can be injected into the exhaust system. An engine control unit, which comprises a microprocessor, is used to select the rate of water injection into the exhaust system as a function of several predefined parameters. For example, engine speed and throttle position can be used by the microprocessor in the engine control unit to select a predefined rate of water flow into the exhaust system by selecting a predefined valve position, for an electronically controlled valve, that has been preselected and stored in a microprocessor.

U.S. Pat. No. 6,406,344, which issued to Bland et al. on Jun. 18, 2002, describes a marine exhaust with dual cooling. A watercraft having two sources of cooling water for injection cooling of hot exhaust gases being conveyed through an exhaust pipe upstream of a muffler is described. The first water source may be an active apparatus such as an engine cooling apparatus. The second source of water may be a passive apparatus such as a Pitot tube formed in the sterndrive of the watercraft. By providing two independent sources of cooling water, the probability of exhaust component failure is significantly reduced.

U.S. Pat. No. 6,537,116, which issued to Nakata et al. on Mar. 25, 2003, describes a cooling system for an outboard motor. The cooling system includes an improved construction that can inhibit a housing unit of the outboard motor from absorbing heat that causes discoloring of the unit. The outboard motor includes a power head that has an engine. The housing unit depends from the power head. An exhaust conduit is arranged to discharge exhaust gases from the engine. At least a portion of the exhaust conduit extends through the housing unit. A cooling system is arranged to cool at least a portion of the exhaust conduit by coolant. The cooling system includes an inner coolant pool surrounding the portion of the exhaust conduit and an outer coolant pool surrounding the inner coolant pool. The cooling system supplies the coolant to the inner and outer pools. The coolant supplied to the outer pool is cooler than the coolant supply to the inner pool.

U.S. patent application Ser. No. 10/182,019, which was filed on Dec. 20, 2001 by Ford et al., describes a marine wet exhaust system. The system injects water into the exhaust flow for cooling and attenuating noise and includes a particulate capture and containment system for removing particulates and water contaminants from the exhaust gas and the waste cooling water of the discharge.

U.S. Pat. No. 6,644,024, which issued to Powers et al. on Nov. 11, 2003, discloses an exhaust system for a marine engine. The exhaust system provides individual exhaust gas conduits that are maintained separately from water conduits until the individual exhaust gas conduits can be combined within a common exhaust gas conduit. This combination of exhaust gas streams allows the amplitude of negative pressure pulses to be damped, by combination with each other, prior to the mixing of cooling water with the exhaust gas streams. Later, the combined exhaust gas stream can be mixed with a combined water stream.

The patents described above are hereby expressly incorporated by reference in the description of the present invention.

In certain outboard motor applications, an idle relief exhaust passage is used in addition to a primary exhaust passage. It would therefore be significantly beneficial if a water spray cooling system could provide cooling water to both the idle relief exhaust passage and the primary exhaust passage through the use of a single water conduit.

SUMMARY OF THE INVENTION

A marine propulsion system made in accordance with a preferred embodiment of the present invention comprises an engine, a first exhaust conduit connected in fluid communication with an exhaust system of the engine, and a second exhaust conduit connected in fluid communication with the exhaust system of the engine. It also comprises a water cooling system configured to conduct water, drawn from a body of water, in thermal communication with at least one heat producing region of the engine. A water conduit is connected in fluid communication with the water cooling system. The water conduit has a first opening disposed to inject a first flow of water into the first exhaust conduit and a second opening disposed to inject a second flow of water into the second exhaust conduit.

In a particularly preferred embodiment of the present invention, the marine propulsion system is an outboard motor. The water conduit can extend through the second exhaust conduit, or idle relief passage, and a distal end of the water conduit can extend into the first exhaust conduit, or primary exhaust passage.

The first and second openings of the water conduit can be disposed within an adapter plate of the marine propulsion system and the second opening can be disposed through a generally cylindrical outer surface of the water conduit. The first opening can be disposed through the generally cylindrical outer surface of the water conduit proximate the distal end of the water conduit within the first exhaust conduit. Alternatively, the first opening can be disposed at the distal end of the water conduit. The first and second exhaust conduits, in a preferred embodiment of the present invention, can extend through an adapter plate of the marine propulsion system and the first and second exhaust conduits can be connected in fluid communication with each other within the adapter plate.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
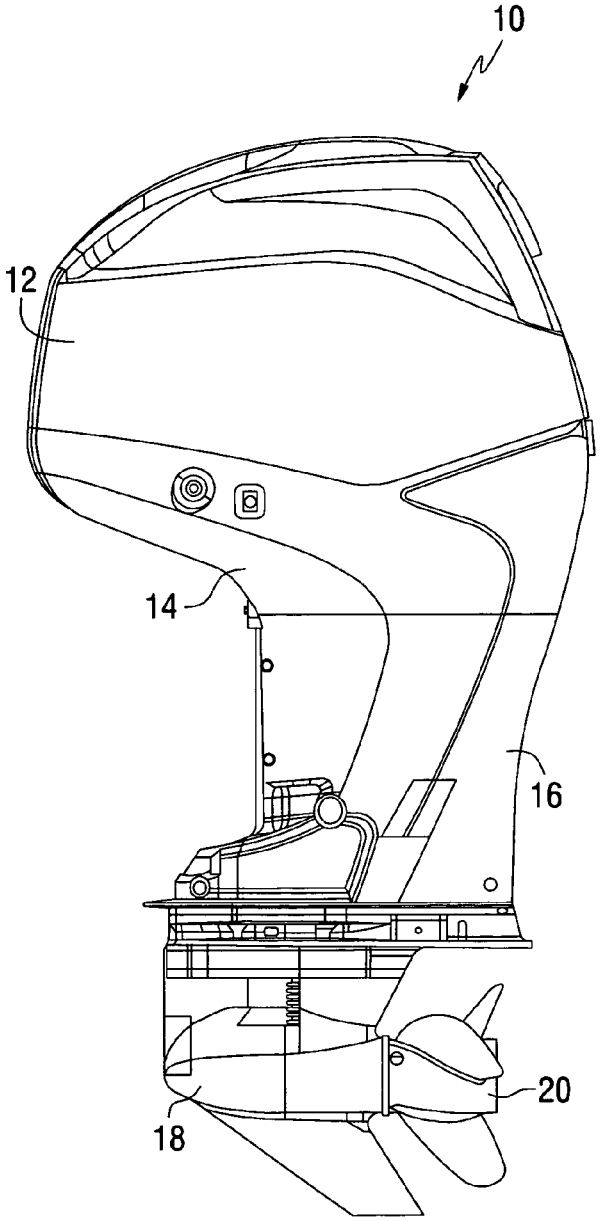
FIGS. 1 and 2 show different views of an outboard motor.

Throughout the description of the preferred embodiment of the present invention, like components will be identified by like reference numerals.

FIG. 1 is a side view of an outboard motor 10. A cowl structure 12 encloses an internal combustion engine, which will be described in greater detail below, with a lower cowl structure 14 enclosing an adapter plate on which the engine is supported. Side covers, or chaps 16, enclose a driveshaft housing which will be described in greater detail below. A gear case 18 is supported by the driveshaft housing and, in turn, supports a propeller shaft for rotation about a horizontal axis. A propeller 20 is attached to the propeller shaft for rotation with the propeller shaft.

Figure 2:
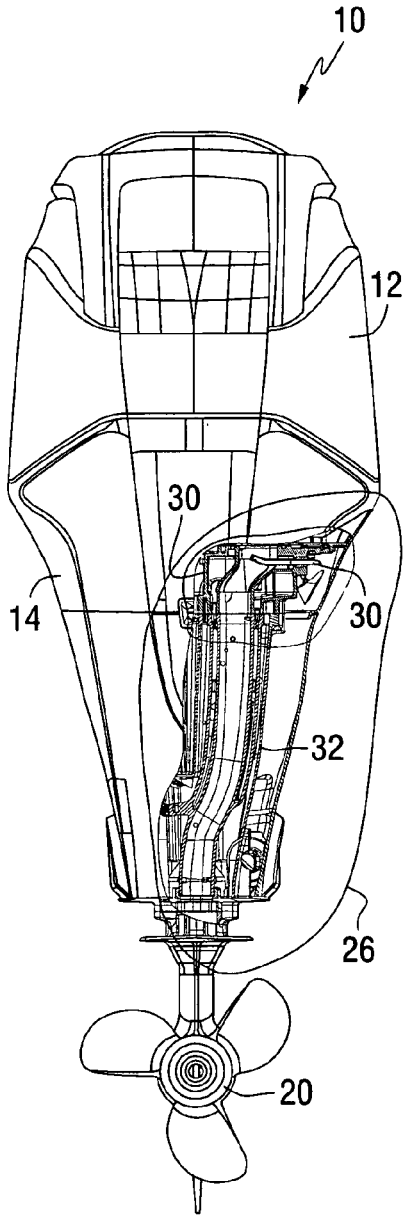

FIG. 2 is a rear view of the outboard motor 10 showing the cowl structure 12, the lower cowl structure 14, the propeller, and a cutaway portion 26 which exposes a portion of the adapter plate 30 and the driveshaft housing 32.

Figure 3:
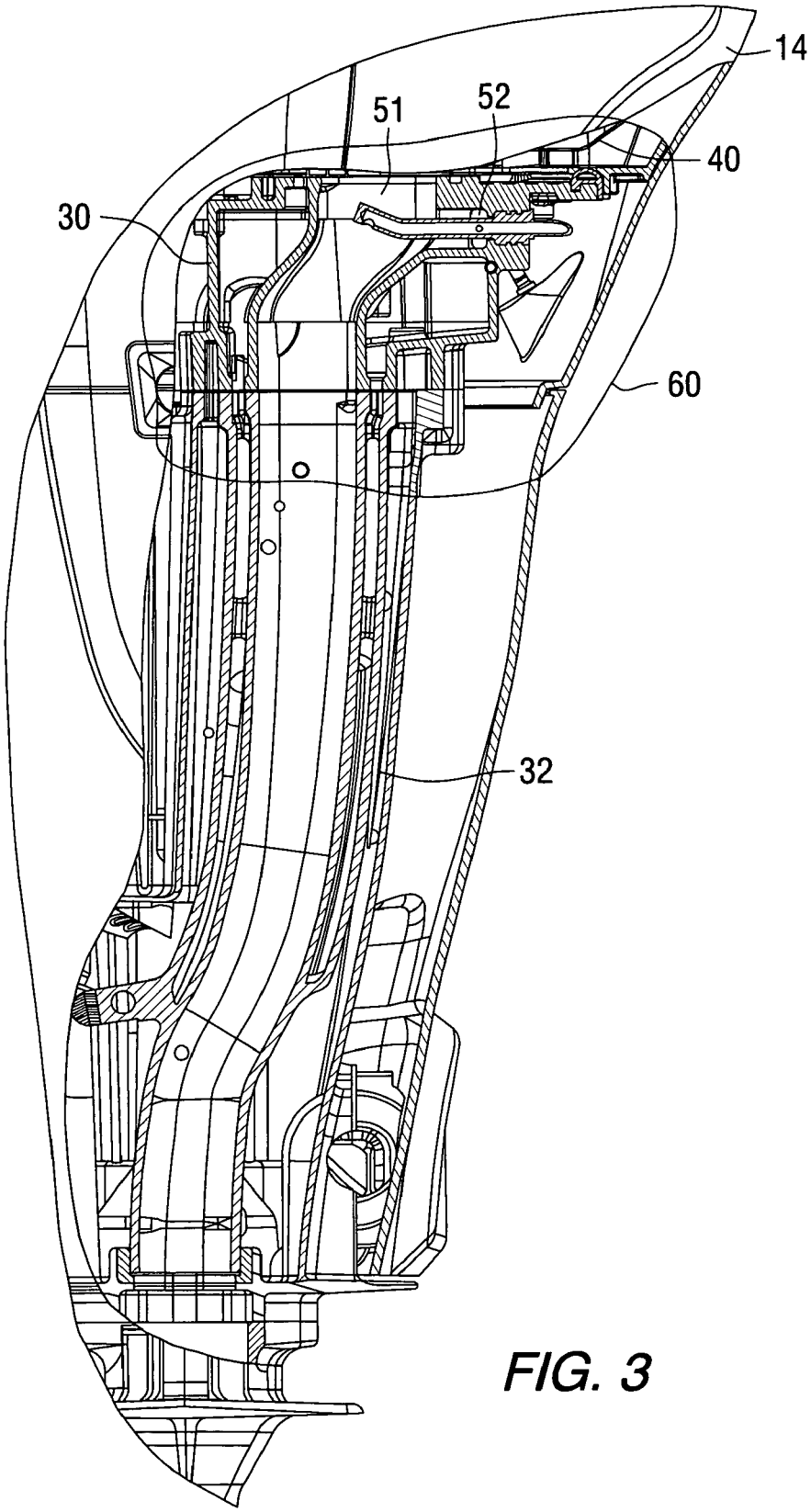
FIG. 3 is an enlarged section view of a portion of an adapter plate and driveshaft housing of the outboard motor shown in FIG. 2.

FIG. 3 is an enlarged view of the sectioned portion 26 described above in conjunction with FIG. 2. The engine 40 is supported by the adapter plate 30. The driveshaft housing 32 is also supported by the adapter plate 30. As will be described in greater detail below, a first exhaust conduit 51 and a second exhaust conduit 52 are formed in the adapter plate 30 to conduct exhaust gases away from the engine 40. An isolated portion 60 of FIG. 3 is illustrated in the enlarged view of FIG. 4.

Figure 4:
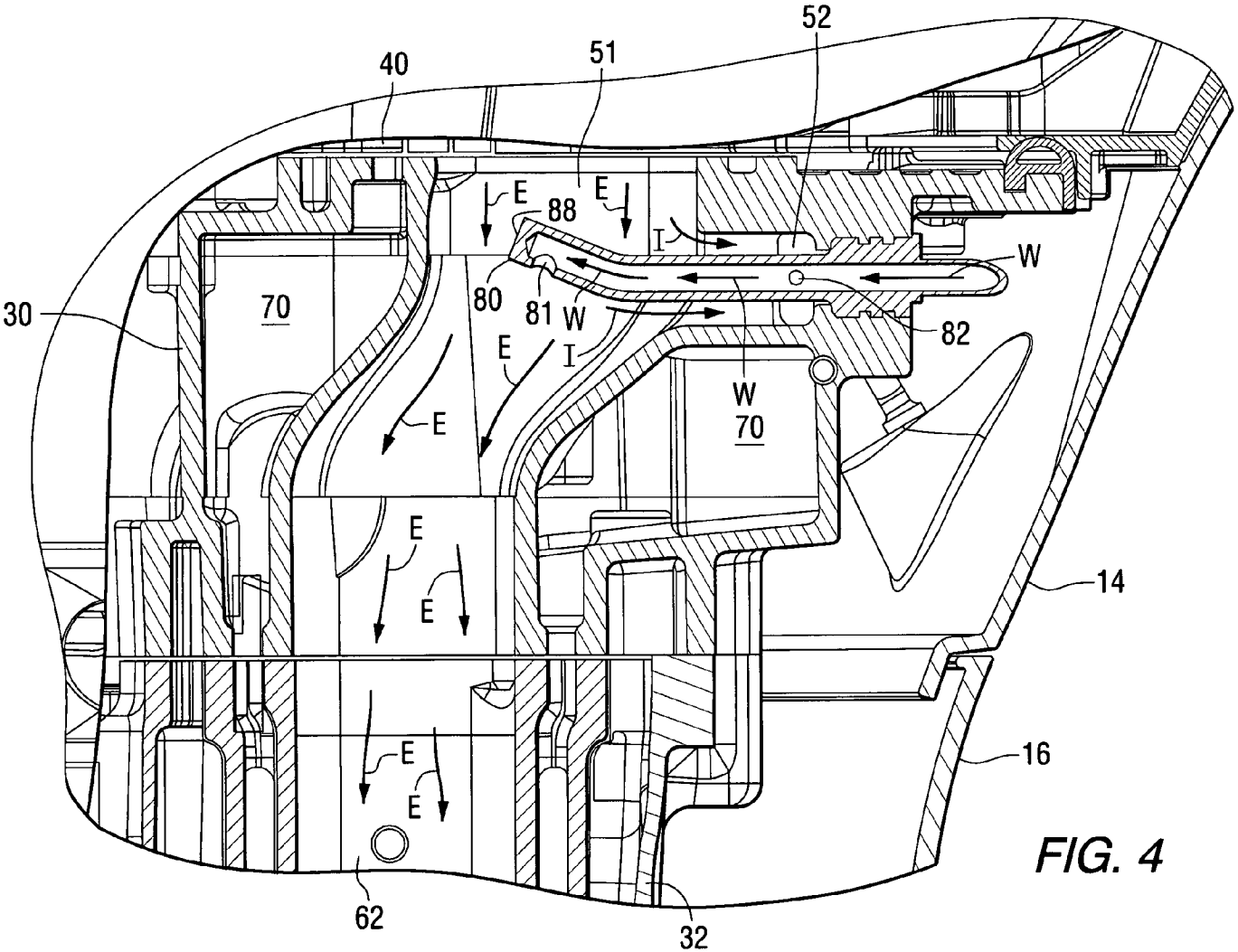
FIG. 4 is an enlarged section view of the illustration shown in FIG. 3.

With reference to FIG. 4, the exhaust gases from the engine 40 flow downwardly through the first exhaust conduit 51 which is connected in fluid communication with an exhaust system of the engine 40. A relatively large proportion of the total exhaust stream from the engine 40 flows downwardly through the first exhaust conduit 51 which is formed through the adapter plate 30, as represented by arrows E, and then continues downwardly through the exhaust passage 62 of the driveshaft housing 32. Some of the exhaust, represented by arrows I in FIG. 4, flow from the first exhaust conduit 51 into the second exhaust conduit 52 which is also connected in fluid communication with the exhaust system of the engine 40.

With continued reference to FIG. 4, several water jacket passages 70 are also illustrated. These water passages illustrated in FIG. 4 are formed as part of the adapter plate 30 and serve as a portion of a water cooling system which is configured to conduct water in thermal communication with heat producing regions of the engine. Those skilled in the art of internal combustion engines are well aware of various shapes and configurations of water jacket passages which are formed as part of an engine 40 and related structures, such as the adapter plate 30. The exhaust gas represented by arrows I in FIG. 4 flows from the first exhaust conduit 51 toward the second exhaust conduit 52 which serves as an idle exhaust relief passage to perform functions that are generally well known to those skilled in the art of outboard motors.

With continued reference to FIG. 4, the preferred embodiment of the present invention comprises a water conduit 80 that is connected in fluid communication with the water cooling system of the engine 40. The water conduit 80 has a first opening 81 disposed to inject a first flow of water into the first exhaust passage 51. The water conduit 80 also has a second opening 82 disposed to inject a second flow of water into the second exhaust conduit 52. Arrows W represent the flow of water through the water conduit 80. Pressure within the water conduit 80 causes the water to flow through the first and second openings, 81 and 82, and spray a stream of water directly into the exhaust gas flow. In a particularly preferred embodiment of the present invention, the first opening 81 is approximately 0.205 inches (5.2 mm) in diameter and the second opening 82 is approximately 0.118 inches (3.0 mm) in diameter. Although not limiting to the scope of the present invention, these particular sizes are chosen to distribute the water W flowing through the water conduit 80 into the first and second exhaust conduits, 51 and 52, in a desired manner. Recognizing that more water is generally needed in the first exhaust conduit 51, the first opening 81 is sized to be larger than the second opening 82 and provides more water into the first exhaust conduit 51 than into the second exhaust conduit 52.

With continued reference to FIG. 4, it can be seen that the water conduit 80 extends through the second exhaust conduit 52 and a distal end 88 of the water conduit 80 extends into the first exhaust conduit 51. As described above, the first exhaust conduit 51 is a main exhaust conduit of the outboard motor and the second exhaust conduit 52 is an idle relief exhaust conduit of the outboard motor. The first and second openings, 81 and 82, are disposed within the adapter plate 30 of the marine propulsion system in the preferred embodiment of the present invention illustrated in FIG. 4. The second opening 82 is formed through a generally cylindrical outer surface of the water conduit 80. In a preferred embodiment of the present invention, the first opening 81 is also disposed through the generally cylindrical outer surface of the water conduit 80, proximate the distal end 88 of the water conduit 80. The first and second exhaust conduits, 51 and 52, extend through the adapter plate 30 of the marine propulsion system and are connected in fluid communication with each other within the adapter plate 30. This connection allows a portion I of the exhaust stream E to flow from the first exhaust conduit 51 into the second exhaust conduit 52.

Figure 5:
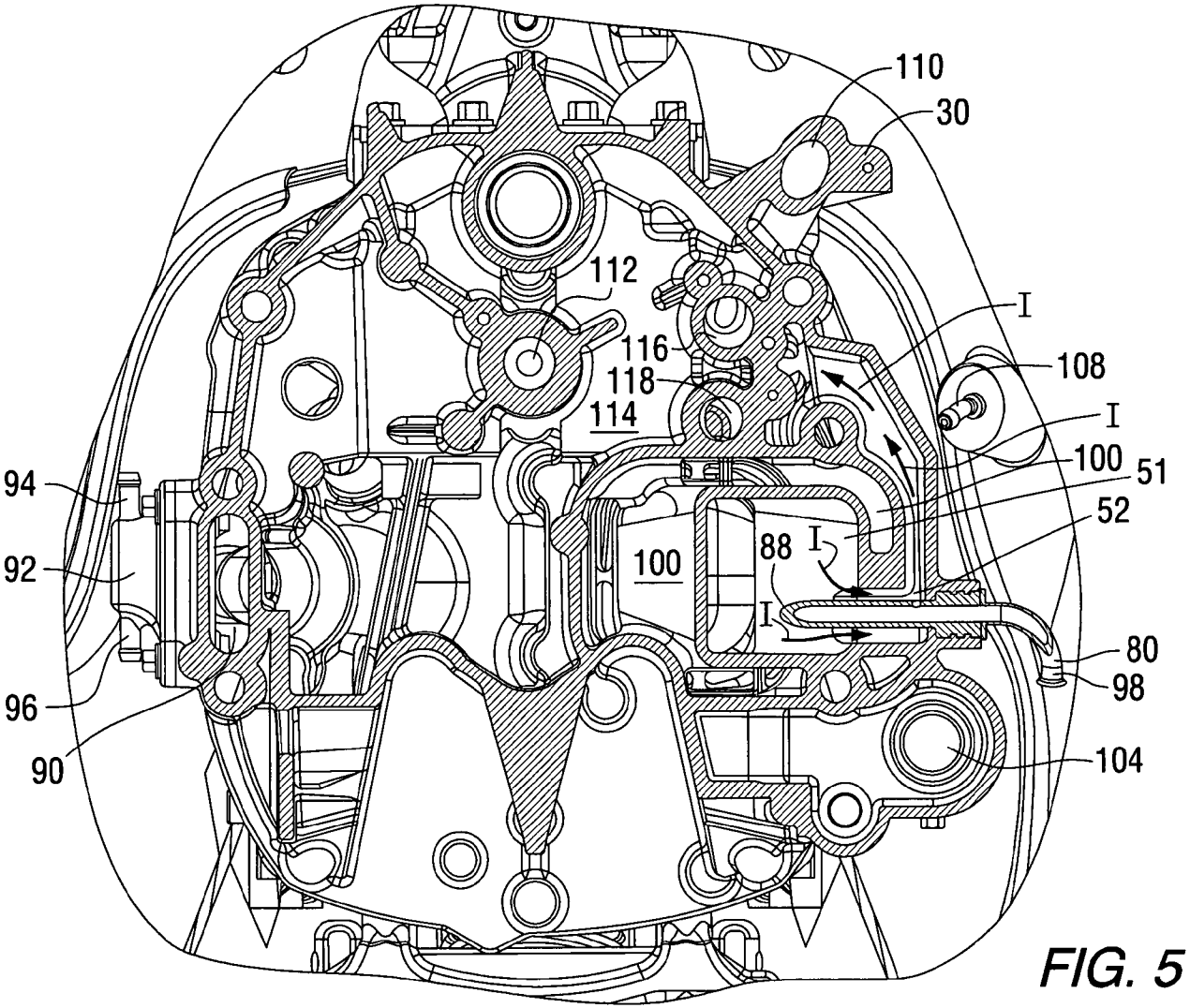
FIG. 5 is a top section view of an adapter plate made in accordance with a preferred embodiment of the present invention.

FIG. 5 is a top view of the adapter plate 30 which is provided to illustrate the present invention from a different perspective and to more completely describe the surrounding environment of the water conduit 80. The first exhaust conduit 51 and second exhaust conduit 52 are shown surrounding portions of the water conduit 80. Cooling water flows upwardly through the adapter plate 30 through the passage identified by reference numeral 90. Some of this water is directed to a T-shaped conduit 92 which, in turn, directs some of that water to a tell-tale through nipple 94 and another portion of that water, through nipple 96, to an inlet 98 of the water conduit 80.

With continued reference to FIG. 5, water which has passed through the cooling passages of the engine then flows downwardly through the passage identified by reference numeral 100 to continue downwardly through water passages in the driveshaft housing. Water flowing through a thermostat of the engine flows downwardly through the passage identified by reference numeral 104. The tell-tale is identified by reference numeral 108. Oil flows upwardly to the engine through the passage identified by reference numeral 110. Oil flows upwardly to the oil pump through the passage identified by reference numeral 112. Passage 114 is an oil drainback area. Oil from the oil pump flows through the passage identified by reference numeral 116 and oil intended for use in piston cooling flows through the passage identified by reference numeral 118.

One of the advantages of the preferred embodiment of the present invention is that it utilizes a single conduit 80 to distribute water, in preferred proportions, to both the first and second exhaust conduits, 51 and 52. By selecting the diameters of the first and second openings, 81 and 82, the proportion of water flowing into the first and second exhaust conduits, 51 and 52, can be preselected since the pressure within the internal cavity of the water conduit 80 will cause the water to be distributed through the first and second openings, 81 and 82, according to their relative diameters. The use of this preferred embodiment of the present invention therefore eliminates a significant amount of the variability that would otherwise take place if the first and second exhaust conduits, 51 and 52, were individually provided with separate water conduits connected to the cooling system of the engine.

With reference to FIGS. 1–5, it can be seen that a marine propulsion system made in accordance with a preferred embodiment of the present invention comprises an engine 40 and first and second exhaust conduits, 51 and 52, which are connected in fluid communication with an exhaust system of the engine 40. A water cooling system of the engine 40 is configured to conduct water in thermal communication with at least one heat producing region of the engine 40. A water conduit 80 is connected in fluid communication with the water cooling system of the engine. The water conduit 80 has first and second openings, 81 and 82, which inject first and second flows of water, respectively, into the first and second exhaust conduits, 51 and 52. In a preferred embodiment of the present invention, the marine propulsion system is an outboard motor 10. The water conduit 80 extends through the second exhaust conduit 52 and a distal end 88 of the water conduit 80 extends into the first exhaust conduit 51. In a preferred embodiment of the present invention, the first exhaust conduit 51 is a main or primary exhaust conduit of the marine propulsion system and the second exhaust conduit 52 is an idle relief exhaust conduit of the marine propulsion system. The first and second openings, 81 and 82, are disposed within an adapter plate 30 of the marine propulsion system. The second opening is disposed through a generally cylindrical outer surface of the water conduit 80. The first opening is disposed through the generally cylindrical outer surface of the water conduit 80 proximate a distal end 88 of the water conduit within the first exhaust conduit 51. The first and second exhaust conduits, 51 and 52, extend through an adapter plate 30 of the marine propulsion system in a preferred embodiment of the present invention and the first and second exhaust conduits, 51 and 52, are connected in fluid communication with each other within the adapter plate 30 in a preferred embodiment of the present invention.

Although the present invention has been described in particular detail and illustrated to show a preferred embodiment, it should be understood that alternative embodiments are also within its scope.

We claim:

1. A marine propulsion system, comprising:

an engine;

a first exhaust conduit connected in fluid communication with an exhaust system of said engine, said first exhaust conduit being a main exhaust conduit of said marine propulsion system;

a second exhaust conduit connected in fluid communication with said exhaust system of said engine, said second exhaust conduit being an idle relief exhaust conduit of said marine propulsion system;

a water cooling system configured to conduct water in thermal communication with at least one heat producing region of said engine; and a water conduit connected in fluid communication with said water cooling system, said water conduit having a first opening disposed to inject a first flow of water into said first exhaust conduit, said water conduit having a second opening disposed to inject a second flow of water into said second exhaust conduit, said water conduit extending through said second exhaust conduit, a distal end of said water conduit extending into said first exhaust conduit.

2. The marine propulsion system of claim 1, wherein:

said marine propulsion system is an outboard motor.

3. The marine propulsion system of claim 2, wherein:

said first and second openings of said water conduit are disposed within an adapter plate of said marine propulsion system.

4. The marine propulsion system of claim 3, wherein:

said second opening is disposed through a generally cylindrical outer surface of said water conduit.

5. The marine propulsion system of claim 4, wherein:

said first opening is disposed through said generally cylindrical outer surface of said water conduit proximate said distal end of said water conduit within said first exhaust conduit.

6. The marine propulsion system of claim 3, wherein:

said first and second exhaust conduits extend through said adapter plate of said marine propulsion system.

7. The marine propulsion system of claim 6, wherein:

said first and second exhaust conduits are connected in fluid communication with each other within said adapter plate of said marine propulsion system.

8. A marine propulsion system, comprising:

an engine, said marine propulsion system being an outboard motor;

a first exhaust conduit connected in fluid communication with an exhaust system of said engine, said first exhaust conduit being a main exhaust conduit of said marine propulsion system;

a second exhaust conduit connected in fluid communication with said exhaust system of said engine, said second exhaust conduit being an idle relief exhaust conduit of said marine propulsion system;

a water cooling system configured to conduct water in thermal communication with at least one heat producing region of said engine; and a water conduit connected in fluid communication with said water cooling system, said water conduit having a first opening disposed to inject a first flow of water into said first exhaust conduit, said water conduit having a second opening disposed to inject a second flow of water into said second exhaust conduit, said water conduit extending through said second exhaust conduit, a distal end of said water conduit extending into said first exhaust conduit, said first and second exhaust conduits extending through said adapter plate of said marine propulsion system, said first and second exhaust conduits being connected in fluid communication with each other within said adapter plate of said marine propulsion system.

9. The marine propulsion system of claim 8, wherein:

said first and second openings of said water conduit are disposed within an adapter plate of said marine propulsion system, said second opening being disposed through a generally cylindrical outer surface of said water conduit.

10. The marine propulsion system of claim 9, wherein:

said first opening is disposed through said generally cylindrical outer surface of said water conduit proximate said distal end of said water conduit within said first exhaust conduit.

* * * * *